US010039319B2

(12) United States Patent
Sawalha

(10) Patent No.: US 10,039,319 B2
(45) Date of Patent: Aug. 7, 2018

(54) IN-LINE PERCOLATOR STYLE FILTER ATTACHMENT DEVICE

(71) Applicant: Bashar Sawalha, Vancouver (CA)

(72) Inventor: Bashar Sawalha, Vancouver (CA)

( * ) Notice: Subject to any disclaimer, the term of this patent is extended or adjusted under 35 U.S.C. 154(b) by 452 days.

(21) Appl. No.: 14/746,233

(22) Filed: Jun. 22, 2015

(65) Prior Publication Data

US 2016/0021929 A1 Jan. 28, 2016

Related U.S. Application Data

(60) Provisional application No. 62/015,077, filed on Jun. 20, 2014.

(51) Int. Cl.

| | |
|---|---|
| ***A24F 47/00*** | (2006.01) |
| ***A24F 1/30*** | (2006.01) |
| ***A24F 1/14*** | (2006.01) |
| ***A24F 13/04*** | (2006.01) |

(52) U.S. Cl.

CPC ..... *A24F 47/002* (2013.01); *A24F 1/14* (2013.01); *A24F 1/30* (2013.01); *A24F 13/04* (2013.01)

(58) Field of Classification Search

None

See application file for complete search history.

(56) References Cited

U.S. PATENT DOCUMENTS

| | | | | |
|---|---|---|---|---|
| 2,815,030 | A | 12/1957 | Wenger | |
| 3,394,710 | A | 7/1968 | Chang | |
| 4,029,109 | A | 6/1977 | Kahler | |
| 9,027,565 | B2 | 5/2015 | Wagenhals | |
| 2010/0163063 | A1* | 7/2010 | Fernando | A24F 47/008 131/184.1 |
| 2012/0199572 | A1* | 8/2012 | Shen | A61M 11/041 219/438 |
| 2013/0104738 | A1* | 5/2013 | Goldstein | B01D 53/14 95/214 |
| 2014/0174457 | A1* | 6/2014 | Merwin | A24F 1/30 131/173 |

(Continued)

OTHER PUBLICATIONS https://nectarcollector.org/ See Attached Picture.

(Continued)

*Primary Examiner* — Michael J Felton
*Assistant Examiner* — Katherine Will
(74) *Attorney, Agent, or Firm* — Rocky Mountain Patent, LLC

(57) ABSTRACT

An attachment device for water percolation filtering of a substance such as a vaporized tobacco or marijuana is provided. The attachment device includes an intake chamber, a mouthpiece and a water pipe percolator section. The intake chamber has an opening configured to receive one of a plurality of secondary device mouthpieces or atomizers in sealing engagement, the secondary device mouthpieces or atomizers each belonging to one of a variety of different corresponding design of devices such as vaporizers. The percolator section is in fluid communication with the intake chamber and the mouthpiece and interposed between the two. The percolator is a dome percolator with a cylindrical housing. The intake chamber and the mouthpiece are oriented as in-line extensions of the cylindrical housing.

23 Claims, 5 Drawing Sheets

(56) References Cited

U.S. PATENT DOCUMENTS

2014/0186015 A1* 7/2014 Breiwa, III ..... A61L 9/03
392/386
2015/0257446 A1* 9/2015 Chung ..... A24F 47/008
131/329

OTHER PUBLICATIONS https://www.smokecartel.com/products/outkast-glass-spoon-bubbler-chubbler See Attached Picture.
https://www.molino-glass.com/product/jelly-fish-double-perc-bp-003/ See Attached Picture.
Cloud Phantom Aqua Bubbler—Lock Version www.cloudvapes.com See Attached Picture.
Barrel Shooter Vape Pen Bubbler www.cannastick.com See Attached Picture.
Aquamizer www.wevape-vaporizers.com See Attached Picture.
Vape Pen Bubbler www.konyovapepen.com See Attached Picture.
GV-N Glass Water Bubbler Vape Attachment www.vapes.com See Attached Picture.
Auqatube Bubbler Extender Kit with Titanium Coil Atomizer www.vaporoustechnologies.com See Attached Picture.
H2 Pen Adaptor www.whiterhinoproducts.com See Attached Picture.

* cited by examiner

IN-LINE PERCOLATOR STYLE FILTER ATTACHMENT DEVICE

CROSS REFERENCE TO REFERENCE TO RELATED APPLICATIONS

This application claims the benefit of U.S. Provisional Patent Application 62/015,077, entitled "IN-LINE PERCOLATOR-STYLE FILTER ATTACHMENT DEVICE" filed on Jun. 20, 2014, the entire contents of which are incorporated herein by reference in its entirety for all purposes.

FIELD OF THE INVENTION

The present invention pertains in general to smoking of tobacco and other substances and in particular to water pipe percolator filters for same.

BACKGROUND

Water percolation filters have been proposed and used as filters for inhaled smoke products such as combusted tobacco and marijuana. Hookahs and bongs are well known examples of devices employing water percolation filters. Water percolation may employed to filter out undesired or harmful components of the inhaled smoke such as fine particles, to cool the smoke, or the like, or a combination thereof. The majority of such water filters are incorporated into large tabletop units. Others are inconveniently shaped for many purposes, and may suffer from design drawbacks due for example to the configuration of the water filter and smoke path.

Electronic cigarettes, personal vaporizers, and similar devices have been introduced to provide an alternative to the traditional method of smoking products via combustion. Such devices typically use an electrically powered atomizer heating element to vaporize a solution containing the product to be inhaled. Combustion and the associated smoke are avoided. Some popular versions of these devices are about pen-sized and pen-shaped, that is, substantially cylindrical and linear, as well as portable, with a battery providing the electrical power for vaporizing the solution.

Although many have purported electronic cigarettes to be "safer" than traditional methods of smoking, regulatory agencies and health officials continue to question these claims.

Therefore there is a need for a water pipe percolator that is not subject to one or more limitations of the prior art.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide an in-line percolator-style water filter attachment device, for example for use with various different vaporizing devices. In accordance with an aspect of the present invention, there is provided an attachment device for water percolation filtering of a substance intended for inhalation, the attachment device comprising: an intake chamber having an opening configured to receive each one of a plurality of substance sources in sealing engagement, the plurality of substance sources each belonging to a different corresponding design of device producing the substance intended for inhalation; a mouthpiece for use in inhaling the substance; and a water pipe percolator section in fluid communication with the intake chamber and the mouthpiece and interposed therebetween, the water pipe percolator configured as a dome percolator, wherein the water pipe percolator section comprises a substantially cylindrical housing, the intake chamber extends substantially in line with the housing and outwardly from a bottom of the housing, and the mouthpiece extends in line with the housing and outwardly from a top of the housing.

BRIEF DESCRIPTION OF THE FIGURES

These and other features of the invention will become more apparent in the following detailed description in which reference is made to the appended drawings.

DETAILED DESCRIPTION OF THE INVENTION

Figure 1:
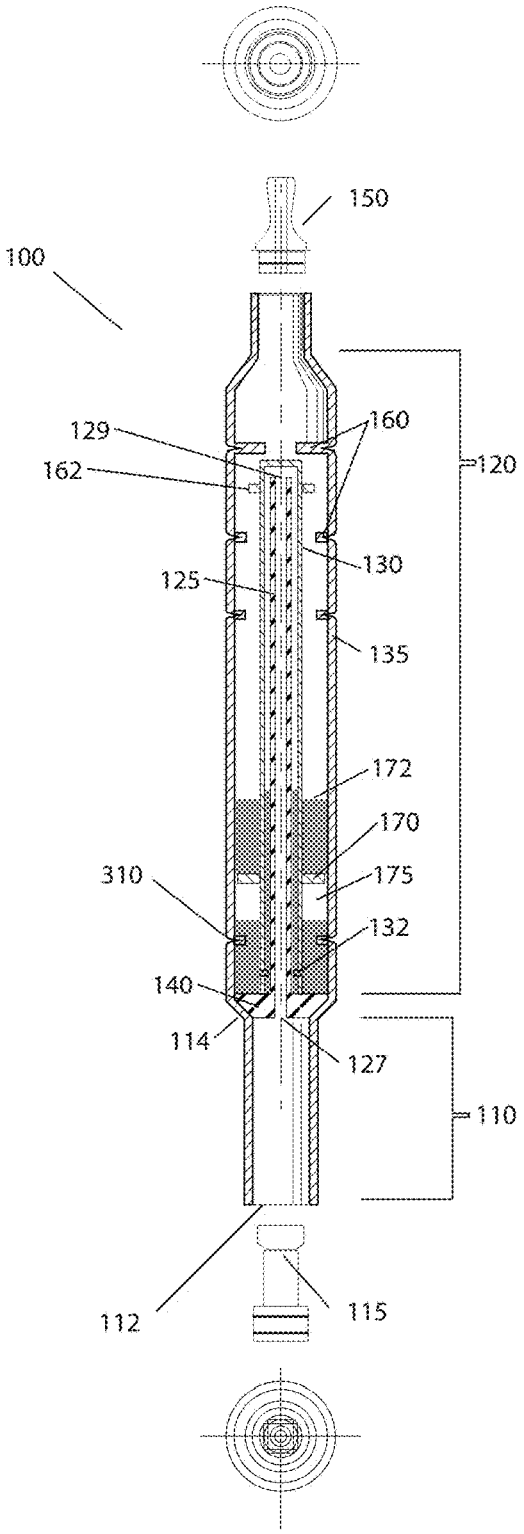
FIG. 1 illustrates a percolator attachment device provided in accordance with one embodiment of the invention.

Unless defined otherwise, all technical and scientific terms used herein have the same meaning as commonly understood by one of ordinary skill in the art to which this invention belongs.

An aspect of the present invention provides for an attachment device for water percolation filtering of a substance intended for inhalation, such as a vaporized tobacco or marijuana substance. The attachment device generally includes an intake chamber, a mouthpiece and a water pipe percolator section. The intake chamber has an opening configured to receive each one of a plurality of substance (smoke or vapour) sources in sealing engagement, the plurality of substance sources each belonging to one of a variety of different corresponding design of devices such as vaporizers or similar devices. It will be appreciated that secondary devices comprise substance sources including, but not limited to atomizers, hukkahs, cigarettes and other devices intended for the delivery of a substance intended for inhalation. The attachment device may therefore be used with various different devices, introducing an aspect of universality. The mouthpiece of the attachment device is also for use in inhaling the substance from the attachment device, rather than from a secondary device mouthpiece received in the intake chamber. The water pipe percolator section is in fluid communication with the intake chamber and the further mouthpiece and interposed between the two. The water pipe percolator is generally configured as a dome percolator, and includes a substantially cylindrical housing. The intake chamber extends substantially in line outwardly from a bottom of the housing, and the further mouthpiece extends in line outwardly from a top of the housing.

It will be appreciated by one skilled in the art that a dome percolator uses pressure differential to draw a fluid volume, typically gaseous, through a second surrounding fluid volume, typically a liquid, separated by a porous boundary permitting the passage of a gas in the presence of a negative pressure differential but does not allow the passage of fluid given a lack of a pressure differential. When a negative pressure is applied to the liquid volume of such an apparatus, gas is drawn from the gas volume, through the porous boundary and through the liquid. In some embodiments the porous boundary comprises an aperture or series of apertures. It will be further appreciated by one skilled in the art and as defined herein, the term "dome" refers to the external boundary of the first fluid volume from the second fluid volume.

Although water is referred to herein as a filtering agent, it is noted that other suitable liquids may be mixed with or used in place of water, and the present invention should not be limited to use with water. For example, a flavouring agent may be added to water. This may impart, via percolation, flavour to the inhaled substance without requiring flavourings to be burnt or vaporized. It is noted that the filter attachment device includes a reservoir of substantially free-flowing liquid through which the material to be inhaled passes.

Notably, the device is an attachment device, rather than a water pipe percolator device which is integrated into a portable vaporizer, e-cigarette, concentrate atomizer, hookah, or other smoke or vapour producing apparatus, and may be provided and sold separately from the vaporizer device. To this end, the device may be configured to fit over the existing secondary device mouthpiece, atomizer or other part of a plurality of vaporizer devices of different types, rather than to be incorporated as a removable or non-removable element of a particular vaporizer device. The attachment device may be a substantially universal attachment device which is operable with various smoke or vapour producing apparatuses, possibly with differently dimensioned substance sources such as atomizers, secondary device mouthpieces, or the like, over which the attachment device is fitted. In order to provide a snug and substantially airtight fit, the attachment device may include one or more resilient rings or shims, such as rubber rings which are placed around the secondary device mouthpiece or other substance source of the smoke or vapour producing device over which the attachment device is fitted. In one embodiment, a plurality of replaceable rings of different thicknesses are provided to accommodate different substance sources such as secondary device mouthpieces or atomizers. More generally, the aperture of the attachment device, into which the substance source is fitted, comprises a resilient component which stretches or compresses when the substance source is engaged, thereby providing a snug fit and gripping action of the substance source by the attachment device. In various embodiments, the intake chamber extends substantially in line outwardly from a bottom of the housing and is tapered, for example with a slightly frustro-conical shape with rounded edge so as not to cut/break the resilient rings or shims.

In some embodiments, the attachment device may optionally be coupled to a head piece, such as a pipe-style piece, used for combustion of a dried smoke-able substance such as dry herb marijuana or tobacco.

In various embodiments, the present invention is configured to provide for an predetermined amount of contact between the filtering water and the smoke or vapour passing therethrough, to provide for a desired amount of filtering and/or cooling of the smoke or vapour while also retaining a desired form factor of the attachment device. In various embodiments, the present invention is configured so that a bubbling effect is achieved when drawing smoke or vapour through the water of the percolator. Such a bubbling effect may enhance the user experience generally, for example visually and audibly.

In some embodiments, the device comprises protrusions which extend into the filtering water and which are configured to contact and disrupt air bubbles containing smoke or vapour to be inhaled as they pass through the water. Disruption of the air bubbles causes them to diffuse and/or separate into plural smaller bubbles, which in turn increases total surface area contact between bubbles and water, thereby increasing filtering and cooling of the smoke or vapour. The protrusions may be formed for example by heating the glass housing and pushing it inward at one or more points to create point-like protrusions, or by narrowing the cylindrical housing substantially uniformly around its circumference using a glass working lathe.

FIG. 1 illustrates a cross-sectional view of a percolator-style filter attachment device 100 provided in accordance with embodiments of the present invention. The attachment device 100 generally comprises an open intake chamber 110 which may be fit over an inhalation secondary device mouthpiece or atomizer, such as the secondary device mouthpiece or atomizer 115 of a portable vaporizer device, e-cigarette, hookah, or the like. The intake chamber 110 may operate as a vapour chamber through which vapour passes and optionally in which vapour may be collected and/or held for a short amount of time prior to filtration. The intake chamber 110 comprises enclosing sidewalls and an open end 112. The intake chamber 110 and open end 112 define a substantially cylindrical cavity which is sized and shaped to accommodate the secondary device mouthpiece or atomizer 115, such that a base of the secondary device mouthpiece or atomizer fits adequately snugly within the open end 112. This may form an airtight seal with the secondary device mouthpiece or atomizer or at least a partial seal which adequately limits the flow of air around the base of the secondary device mouthpiece or atomizer into the intake chamber 110. As illustrated, the intake chamber extends substantially in line outwardly from a bottom of the housing and is tapered.

The attachment device 100 further comprises a water pipe percolator section 120 in fluid communication with the intake chamber 110, so that vapor can be drawn from the intake chamber 110 into the water pipe percolator section 120. The water pipe percolator section 120 resembles a dome percolator comprising an inner pipe 125, a dome 130, and a housing 135, which are all substantially coaxial cylinders in the illustrated embodiment. As illustrated, the intake chamber 110 is also formed as a cylinder coaxial with these cylinders. Alternatively, instead of the different recited cylinders being coaxial, they may be parallel but located within an envelope defined by an indefinitely extending cylinder which is coaxial with and has the same radius as the largest cylinder. A base 140 separates the water pipe percolator section 120 from the intake chamber 110. A narrowing feature 114 enables the connection between the base 140, intake chamber 110. The inner pipe 125 is substantially straight and cylindrical and passes through the base 140 while being connected to the base 140 for support. The inner pipe 125 has a first open end 127 in fluid communication with the intake chamber 110, and a second open end 129 in fluid communication with a space interior to the dome 130. The dome 130 is formed around the inner pipe 125 and is substantially sealed except for one or more apertures 132 or slits located proximate to the base 140. The apertures are located below the open end 129 of the inner pipe 125 and also designed to be immersed in water when water is added to the percolator and the attachment device is held in an operative position. The apertures 132 provide fluid communication between the interior and exterior of the dome 130.

The attachment device 100 further comprises a mouthpiece 150 for use in applying suction in order to draw product out of the attachment device for inhalation. The mouthpiece may be formed of glass and may be removable, replaceable, and may optionally be manufactured by a third party. As illustrated, the aperture 110, water pipe percolator section 120 and the mouthpiece 150 are all collinear. In some embodiments, the attachment device 100 may optionally be used without the mouthpiece or the mouthpiece may be excluded.

In some embodiments, the dome 130 is integrally formed with the base 140. For example, the attachment device 100 may be a substantially unitary structure formed of glass or other suitable material. The unitary structure may be cleaned by filling with or immersing with alcohol or other suitable solvent. However, the mouthpiece 150 may be a separate piece which fits with the attachment device 100. The unitary structure provides for a convenient, substantially assembly-free product. The mouthpiece 150 and attachment device 100 may interlock to achieve a compact, for example pocket-sized, bulb. In other embodiments, the dome 130 may be removably attached to the base 140, for example by a bayonet lock, magnetic attachment, or the like.

Figure 2:
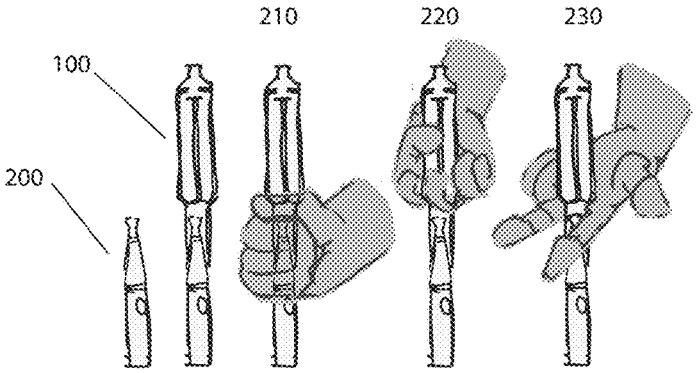
FIG. 2 illustrates a percolator attachment device having a grip, in accordance with one embodiment of the invention.

In some embodiments, the exterior surface of the housing 135 comprises a grip, for example as illustrated in FIG. 2. The grip allows for a convenient surface for holding the attachment device and portable vaporizer device, e-cigarette, or the like, attached thereto. This may correct a drawback of certain portable devices, for example those containing atomizers, which may be inconvenient to hold due to their size. The housing 135 thereby advantageously provides for a gripping surface on its exterior while also providing a housing for the water filtering function. The gripping surface may provide for an enhanced user experience and handling of the attachment device 100 and device attached thereto. In one embodiment, the gripping surface is a roughened surface on the exterior of the cylindrical body of the housing 135. In another embodiment, the gripping surface corresponds to the narrowing feature 114 at which the housing 135 narrows to the intake chamber. This narrowing feature 114 provides a flared surface which is substantially horizontal during use and where the attachment device 100 can be rested against the fingers of a user.

In operation, suction pressure applied at the mouthpiece 150 while smoke or vapour is applied via the secondary device mouthpiece or atomizer 115 of the portable vaporizer device, e-cigarette, hookah, or the like. The smoke or vapour is drawn through the intake chamber 110, inner pipe 125, the space interior to the dome 130, through the apertures 132 and finally through the space exterior to the dome 130 to the mouthpiece 150. The smoke or vapour passes through and is filtered by water which resides in a bottom portion of the water pipe percolator section 120 in spaces adjacent to the dome percolator interior and exterior.

In various embodiments, splash guards 160 are provided proximate to the mouthpiece 150. The splash guards may be integral with the housing 135 and may be formed as projections extending inwardly from the housing 135. The splash guards are configured to inhibit splashing of water from the bottom portion of the water pipe percolator section 120 into the mouthpiece 150 during use. Splashing of water may occur due to bubbling caused by drawing air through the water pipe percolator section.

In some embodiments, the splash guards comprise plural layers of substantially triangular projections, arranged to form a stack of at least two star-shaped openings which are rotationally offset relative to each other so that at least some parts of one opening is out of alignment with corresponding parts of an adjacent opening. More generally, the splash guards may be arranged to form a more resistive path, including but not limited to a substantially tortuous path or turbulent path, between the bottom portion of the water pipe percolator section 120 and the mouthpiece 150, forming a barrier for water splashes while allowing smoke or vapour to travel to the mouthpiece 150. Alternatively, the splash guards may comprise vertically offset discs with holes formed therein, i.e. perforated discs, for passing vapour or smoke, the holes of each disc being rotationally offset from the holes of neighbouring discs.

In some embodiments, the splash guards are formed as narrowing portions of the cylindrical housing 135, said narrowing portions extending around the circumference of the housing 135 and projecting uniformly inward. Such projections may be substantially symmetric about arbitrary rotations of the housing about its central axis. This separates at least an upper part of housing into a plurality of bulbous chambers. In some embodiments, this configuration may also slow the flow of water toward the mouthpiece 150 opening when the attachment device is laid on its side, i.e. horizontally. The narrowing portions operate as walls which impede the flow of water when the attachment device is laid on its side. Even if the volume of water is large enough to overcome one or more of these walls, the walls may interrupt the momentum of the water so that when the water reaches a further wall it will not so readily flow overtop due to momentum. This further wall may be defined by another splash guard or defined by a narrowing of the housing at the mouthpiece 150.

In some embodiments, as demonstrated in FIG. 1, a hydrolock 162 is mounted on the dome 130 and extends outward. For example, such a hydrolock may exhibit a ring form extending from the outer surface of the dome 130. In some embodiments, such a hydrolock 162 may be used in conjunction with a splash guard 160 extending inwardly from the housing 135, and further the outer circumference of the hydrolock 162 mounted to the dome 130 may be greater than the inner circumference of the splash guard extending inwardly from the housing, thereby providing for a tortuous path and substantially blocking all straight-line paths from the water surface to the mouthpiece 150 opening. The inwardly extending splash guard may be formed from a ring inserted into the housing or by inward deformation of the housing.

It will be appreciated by one skilled in the art that the term "hydrolock," as used herein refers to a feature that allows the passage of gaseous fluid in a neutral pressure environment as well as in the presence of a pressure differential. It will be further appreciated by one skilled in the art that a hydrolock prevents the passage liquids in the presence of a neutral pressure environment and further mitigates the passage of liquid fluids in the presence of a pressure differential. Certain embodiments of the invention employ hydrolocks that rely on the cohesive properties of certain liquids, such as water, to prevent the passage of the liquid through an aperture in neutral pressure environments or static pressure associated with a volume of water.

It will be further appreciated that a ring may be used in numerous capacities including, but not limited to a hydrolock or splash-guard.

In certain embodiments, as demonstrated FIG. 1, an annular aperture created by the integration of a hydrolock 162 between the dome 130 and the interior of the cylindrical housing 135 exhibits a dimensionality preventing the passage of a fluid of liquid form, such as water, in the absence of a pressure differential. This enables a user to place the attachment device 100 in any configuration, including horizontal or vertically upside-down without the release of the liquid held within. It will be appreciated that certain embodiments may exhibit a singular hydrolock, while alternative embodiments may exhibit a plurality of hydrolocks creating multiple volumes of liquid within the attachment device 100.

In some embodiments, the dome 130 and possibly also the inner pipe 125 extend upward from the base 140 to pass by at least some of the splash guards extending inwardly from the cylindrical housing. That is, the distance from the base to the top of the dome 130 is greater than the distance from the base to at least the first inwardly extending splash guard. By extending the height of the dome 130 and the inner pipe 125, the amount of water and hence the amount of filtration can be increased.

As illustrated in FIG. 2, the percolator attachment device 100, which is coupled to a portable vaporizer 200, can be gripped in a variety of ways, for example by 210 grasping the bottom of the attachment device and the vaporizer, by 220 resting the flared surface between the intake chamber and the housing against the fingers and grasping the exterior of the housing, or by 230 resting the flared surface between the intake chamber and the housing against the fingers without grasping.

Figure 3:
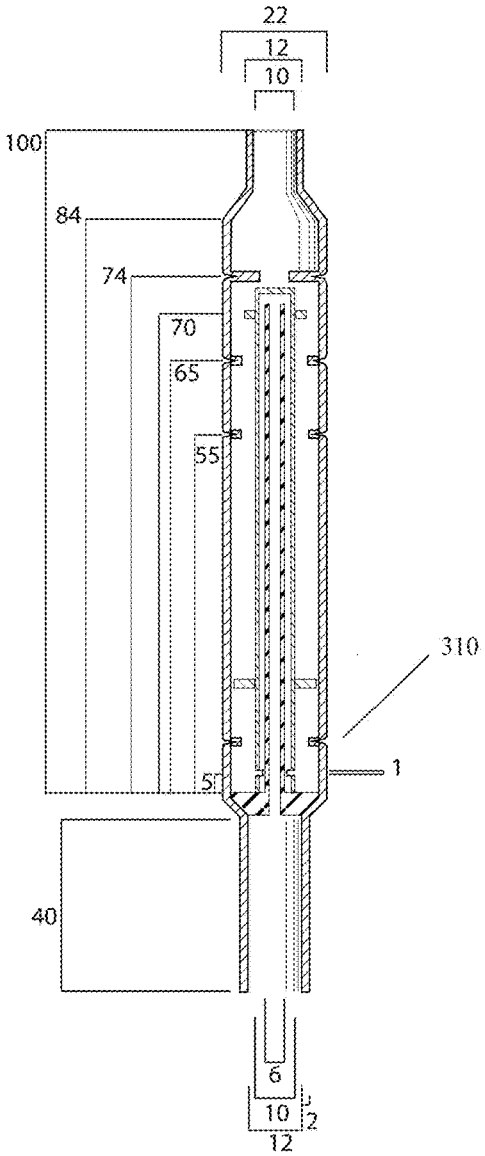
FIG. 3 illustrates a cross-sectional view of an attachment device according to some embodiments of the present invention, including dimensions of various components thereof.

FIG. 3 illustrates a cross-sectional view of an attachment device according to some embodiments of the present invention, including dimensions of various components thereof. Dimensions are in millimeters. FIGS. 1 and 3 further illustrate protrusions 310 which extend from the housing inwardly into the water to break bubbles containing smoke or vapour into smaller bubbles. Additionally or alternatively, the protrusions may extend outwardly from an outer surface of a dome contained within the housing. In some embodiments, the protrusions may be formed for example by heating the glass housing to a malleable state and pressing the glass inward at an appropriate location to form the protrusions. The protrusions may be formed as spikes or a cylindrical narrowing which extends around the housing, or the like. Additionally or alternatively, a roughened inner surface may be used to break up bubbles contacting same. Additionally or alternatively, a screen may be located in the water to contact and break up the bubbles.

In some embodiments, in addition to or alternatively to the protrusions as described above, a ring may be located below a top water line and used to break up bubbles as they pass by the edge of the ring, as described elsewhere herein.

In various embodiments, the attachment device of the present invention provides a substantially sealed interior between the intake chamber and the mouthpiece of the attachment device. That is, when the attachment device is coupled to a portable vaporizer or other device, the attachment device is open only at the mouthpiece of the attachment device. Notably, the attachment device of such embodiments excludes a "choke" or carburetor hole which is typically provided for selective covering or uncovering by a finger to variably introduce outside air into interiors of other smoking devices such as bongs. It has been recognized by the inventor that such a hole is unnecessary for portable vaporizers due to their particular construction and mode of operation. For example, since atomization can be quickly started and stopped by press and release of an electronic control button, there is no need to introduce external air through such a "choke" hole to clear vapour from the attachment device.

Furthermore, by providing a substantially sealed interior as described above (including absence of a "choke" hole), some embodiments of the present invention may assist in providing for an anti-spill feature whereby water is inhibited from spilling out of the attachment device due to gravity by virtue of air trapped therein. For example, such an anti-spill feature may inhibit water spillage from the attachment device when it is laid sideways on a table. Water may be inhibited from spilling out of the aperture leading to the atomizer, for example. For an atomizer having an outside air intake that is substantially sealed when the atomizer is not in use, a pocket of air is substantially trapped between the water of the percolator section and the atomizer. This pocket of air provides the back pressure to prevent backspills of water into the atomizer or other portions of the personal vaporizer or electronic cigarette, which may otherwise damage it. However, at least some anti-spill functionality may still be present even absent such a sealed pocket of air.

Figure 4:
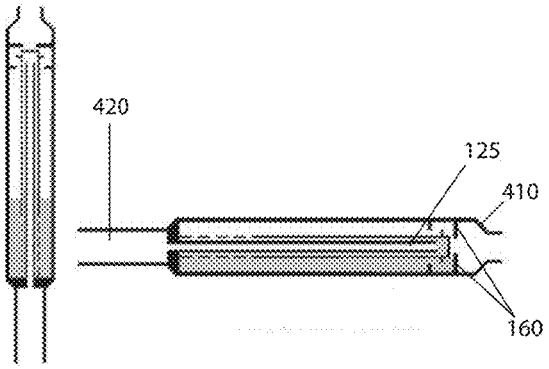
FIG. 4 illustrates a cross-sectional view of an attachment device configured to inhibit water spillage when laid on its side, according to some embodiments of the present invention.

In some embodiments, the attachment device is also configured to inhibit water spillage out of the attachment device mouthpiece. This may be due to shape of the attachment device, for example. In some embodiments, the attachment device is provided with sufficient headspace within the percolator section so that a predetermined volume of water contained in the attachment device and sufficient for operation is accommodated within the percolator section without spilling out of the attachment device mouthpiece when the attachment device is oriented sideways, for example laid on a table. In some embodiments involving a cylindrical percolator section, this may be provided by configuring the attachment device so that the percolator section is less than half filled with water. FIG. 4 illustrates an example in which the attachment device is laid on its side but filled with water to a level at which water does not escape. As illustrated, a splash guard 160 inhibits water from escaping out of the mouthpiece aperture, although in alternative embodiments the narrowed neck feature 410 of the mouthpiece aperture may also perform this function should the water spill over the splash guard. FIG. 4 also illustrates a trapped pocket of air 420 having back-pressure sufficient to inhibit water from entering the inner pipe 125.

Various embodiments of the present invention provide for a hand-held percolator filter attachment device that is substantially straight and designed to be placed in line with a portable vaporizer device such as an electronic cigarettes or pen-style personal vaporizer. In this configuration, the filter may be attached to the portable vaporizer device such that its straight, for example cylindrical, body is located in line with the atomizer heating element of the personal vaporizer. This forms a substantially straight assembly comprising the personal vaporizer and the percolator filter attachment device. The percolator filter itself is contained within the body and is also located in line with the atomizer heating element.

Such an in-line configuration may be advantageous in that it offers a desirably compact, balanced and non-tortuous external form and convenient location for gripping the filter and/or portable vaporizer device. Weight is distributed substantially evenly around the axis of the attachment device to facilitate balance. The attachment device may be compact for stowage, for example in the manufacturer-provided portable vaporizer case.

Various embodiments of the present invention provide for a percolator filter attachment device which has a hollow housing which functions both for containing the water via its interior surface and also, via its exterior surface, as a convenient grip for holding the percolator filter attachment device and components attached thereto, such as a portable vaporizer device, for example as already described above. Gripping surfaces may include roughened or ground glass, for example.

Traditional combustion methods of smoking require that the smoking apparatus be held at a certain angle. For example, cigarettes are generally held horizontally to avoid problems with the cigarette burn rate. Pipes are generally also held in such a fashion to avoid loss of tobacco and proper combustion. This presents a challenge to the design of water pipe percolators attached to the mouthpiece of such smoking apparatus, namely in that such a percolator should not leak water when the smoking apparatus is held at the appropriate angle.

Figure 5:
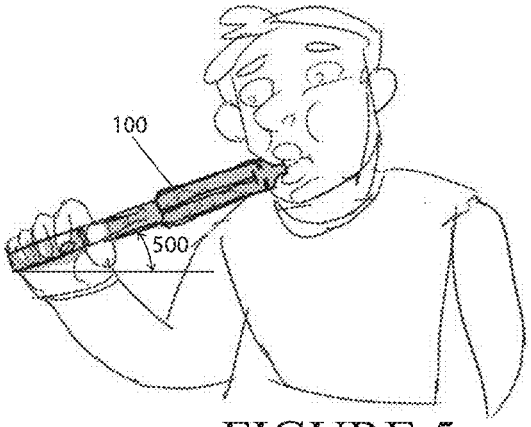
FIG. 5 illustrates use of a percolator attachment device provided in accordance with one embodiment of the invention.

In contrast, portable vaporizers which use an atomizer are may not be subject to such limitations on their orientation. Indeed, it is popular to hold pen-style vaporizers and e-cigarettes so that their body is angled downward from the horizontal as shown for example in FIG. 5 during use. Embodiments of the present invention leverage this feature of portable vaporizers to allow for a different design of the water pipe percolator than would otherwise be feasible, and hence such embodiments may be designed for use with such portable vaporizers. For example, the percolator filter attachment device 100 illustrated in FIG. 5 can be held at the illustrated angle 500 without water leakage, and is therefore feasible for use with portable vaporizers. The percolator filter may further be held at a variety of other angles, although it is noted that the illustrated design may leak water when angled to and/or through certain orientations. Of course, it may generally be desirable to be able to drain water from the percolator filter attachment device for cleaning or storage purposes, this may be achieved for example by removing the attachment device's mouthpiece and orienting the device so that the aperture for holding the mouthpiece points generally downward but at an angle, so that an open air channel reaches into the mouthpiece at the same time that water flows out and the water does not form a seal around the mouthpiece. Remaining water trapped in the dome may be removed by slowly orienting the device horizontally for a period of time and then repeating this process.

As will be readily understood by a worker skilled in the art, portable vaporizers or electronic cigarette or other products containing atomizers include a visible light for example associated with the atomization of material. In some embodiments, the attachment device may be formed of glass or other transparent or translucent material, which is configured to interact with the light from the atomizer in a manner that produces a glowing effect of the attachment device. For example, the glass body of the attachment device may catch and diffuse the light to produce an enhanced visual effect. In some embodiments, the attachment device may be configured to produce a desired visual light effect. For example, a glass surface of the attachment device may be ground or roughened to adjust how light is diffused, or light guides may be incorporated into the glass. As another example, fluorescent or phosphorescent materials may be integrated with the attachment device housing to produce further visual effects. For example, uranium glass which fluoresces under ultraviolet light may be used. Such materials may optionally be formed in a layer which does not contact an interior surface of the attachment device.

Figure 6:
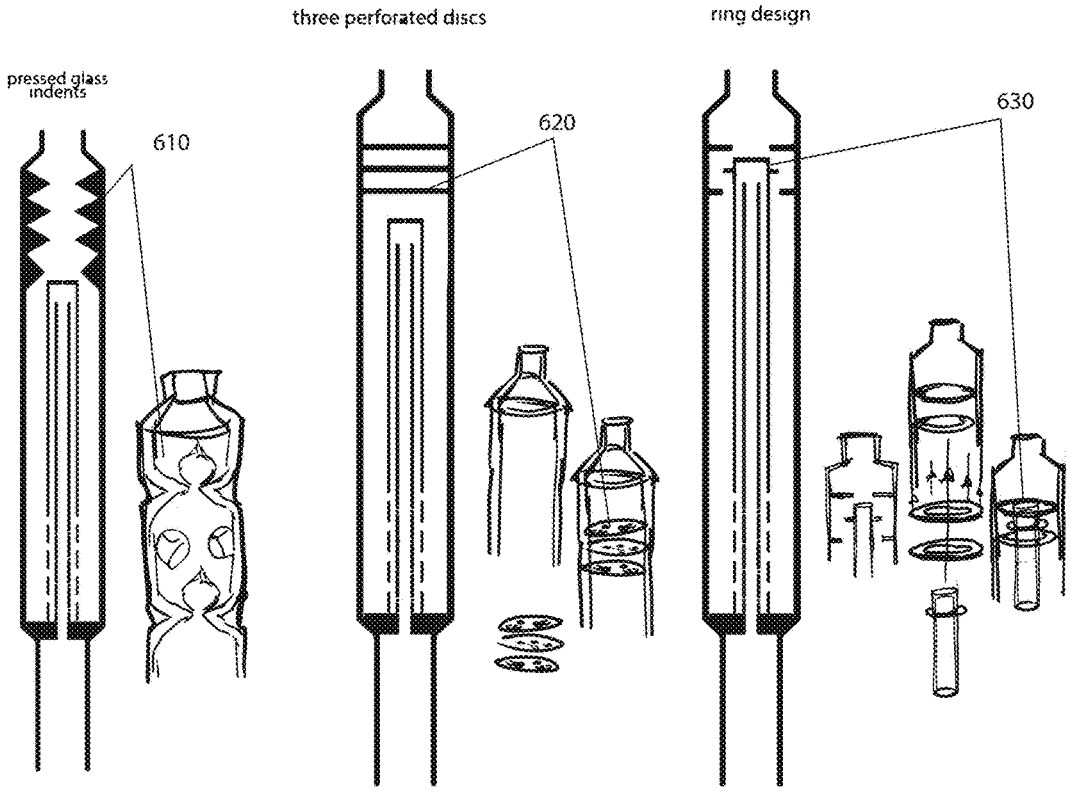
FIG. 6 illustrates various internal features of the percolator in accordance with embodiments of the present invention.

In various embodiments, the interior of the percolator section may include one or more of: projections extending inwardly from the housing, perforated discs located above a top of the dome 130 of the percolator, and hydrolocks either mounted to an exterior surface of the percolator dome 130 or to an interior surface of the percolator housing. Such features may correspond, for example, to splash guards as described elsewhere herein. FIG. 6 illustrates an example of inwardly extending projections 610, plural stacked perforated discs 620 and rings 630. The features 160, 310 of FIG. 1 may be either inwardly extending projections or rings, and similarly various inwardly extending projections formed in the housing sidewall as described herein may be provided by the use of push rings inserted into the housing and vice-versa. In some embodiments, glass push-rings may be heated prior to insertion into the housing or overtop of the dome 130, in order to increase flexibility during insertion.

In one embodiment, the discs or rings may be pushed or slid into place and held for example by friction against the inner sidewalls of the housing. In another embodiment, at least some of the rings may be pushed or slid into place and held for example by friction against the outer sidewall of the dome, while others may optionally be held against the inner sidewalls of the housing. Alternatively the discs or rings may be affixed by other means, such as by heating to melt and solidify glass edges of the discs or rings in order to hold same in place.

The inwardly extending projections may be formed for example by use of a glass working lathe, by rotating the glass housing along its axis, heating portions thereof and pushing the heated portions inward to form "V" shaped or "U" shaped depressions in the housing with a suitable instrument. Alternatively, the glass may be worked by known glass working methods to define adjacent bulbous portions of the housing, wherein the region between these bulbous portions correspond to the inwardly extending projections. Such inwardly extending projections may be formed at various locations along the housing, for example to form splash guards or bubble-interrupting features.

In some embodiments, at least one ring may be located below a water line of the percolator section and held between the inner sidewall of the housing and the outer sidewall of the dome 130. Such a ring may optionally substantially contact both the inner sidewall of the housing and the outer sidewall of the dome 130 to form a barrier within the percolator section, however the barrier may be imperfect in the sense that air, the substance to be inhaled, and optionally water may flow past the inner and/or outer edges of the ring in at least some locations. This may be due to a slight shape mismatch between the edges of the ring and the sidewalls being contacted, for example due to inherent manufacturing mismatches in the mating parts. Alternatively, the ring's inner or outer circumference may be configured to define a gap of predetermined size, for example a fraction of a millimeter, between the ring and either the inner sidewall of the housing or the outer sidewall of the dome 130. The ring is not fused or bonded to one or more of the sidewalls as such locations but rather may be held in place by friction. Therefore, under inhalation pressure, the substance for inhalation flows past the edges of the ring barrier through the narrow spaces between the ring and the percolator sidewalls. This may increase contact surface area between water and the substance intended for inhalation and may lead to the formation of smaller bubbles of substance since the substance is forced through narrow channels. In some embodiments, the shape mismatch may cause the contact surface between the ring and the sidewalls to be discontinuous, that is, including small gaps which may not be visible to the eye. These gaps define channels through which the substance intended for inhalation can passes under inhalation pressure. In some embodiments, the gap or gaps are formed at the outer circumference of the ring, thereby allowing a greater total gap cross sectional area compared to potential gaps formed at the inner circumference of the ring.

In some embodiments, when the gap formed between ring and sidewall is suitably small, an air pocket or air bubble may be formed below the ring, while a quantity of water may be held atop of the ring. In one embodiment, negative pressure due to the air pocket causes some of the water to be retained atop of the ring. This creates the effect of a pair of stacked percolators separated by the air pocket. The ring may inhibit the downward flow of water via a similar mechanism to how the narrow channel near the mouthpiece inhibits water spillage, as described below. In some embodiments, when water retained atop of the ring completely covers the ring gap to form a seal, it is inhibited, for example by one or both of surface tension and air pressure from the air pocket beneath, from pouring downward through the ring gap. As air is drawn under inhalation pressure through the percolator, some water may also be drawn upward through the ring gap, thereby defining or increasing the size of the air pocket. When the water seal is broken, air may flow downward through the ring gap at a limited rate.

It will be appreciated that surface tension, associated with the cohesive properties of a liquid and/or adhesive interaction with surrounding bodies, such as a glass container. As such, an aperture allowing the transference of liquid to a gaseous volume, for example, has a pressure threshold if not exceeded, will not allow the transference of liquid. It will also be appreciated that the pressure associated with a volume of liquid is associated with the depth, or liquid column height, at the calculated point of pressure. It will be further appreciated that for an aperture separating a volume of liquid from a gaseous volume to prevent the transference of the volume of liquid to the gaseous volume, such an aperture must be sized such that the pressure required to overcome the surface tension associated with the aperture is greater than the pressure associated with the fluid column height of the volume of liquid.

FIG. 1 illustrates an embodiment utilizing a plurality of hydrolocks, wherein secondary hydrolock 170 is located below an upper water line 172. The substance to be inhaled may pass through a small gap at the outer edge of the hydrolock 170. As illustrated, an air pocket 175 may be formed below the hydrolock 170 as discussed above. Water may be held above the hydrolock 170 due, for example, to air pressure and/or water surface tension associated with the small gap between the outer edge of the hydrolock 170 and the housing 135. As shown in FIG. 1, certain embodiments demonstrate dissimilarly dimensioned hydrolocks.

In addition, the ring may assist in inhibiting airflow into the percolator section from the intake chamber in order to assist in retaining water in the percolator when it is inverted as will be described below.

In some embodiments, a top portion of the percolator section, proximate to the mouthpiece, may be configured to define a narrow channel which is sufficient for passage of the substance intended for inhalation, but which is also sufficiently narrow to allow water to be retained within the percolator section when the mouthpiece is pointed downward. This effect may be due in part to an effect of upward air pressure. Water surface tension may also have an effect in retaining the water in place in this configuration. In some embodiments, such an action for retaining water in a narrow channel may be seen as comparable to the action of a pipette used to transport limited volumes of fluid for example in laboratories.

The narrow channel may be formed, for example by locating a top of the percolator's dome 130 sufficiently close to an inwardly extending circular protrusion of the housing, for example corresponding to a splash guard feature of the housing. Additionally or alternatively, the rings or perforated discs may be used to define such a narrow channel. In one embodiment, the width of the narrow channel is on the order of a fraction of a millimeter to one millimeter. However, the cross-sectional area of the narrow channel may be defined on the basis that upward pressure due to ambient air and/or water surface tension is sufficient to hold a predetermined height of water in place.

In some embodiments, the water is backed by an air pocket trapped in the percolator section under partial vacuum and hence of lower pressure. As discussed previously, when the device is connected in a sealed manner to an atomizer which has an outside air intake that is substantially sealed when the atomizer is not in use, a pocket of air is substantially trapped between the water of the percolator section and the atomizer. This may create a partial vacuum above the water when the device is inverted, and ambient air tends to push upward against the water at the narrow channel in response to this vacuum. More generally, the intake chamber opening may be sealed off, and hence ambient air presses against the water substantially only in the vicinity of the narrow channel. Such ambient air pressure against the water and/or partial vacuum, coupled with the surface tension of the water, may tend to prevent the water from spilling out of the device due to gravity for certain small channel surface areas, and the narrow channel may be designed with such a surface area.

Figure 7:
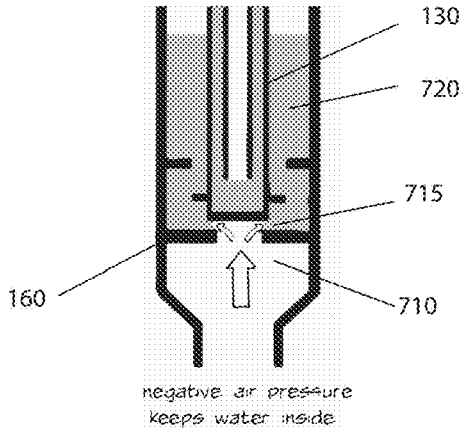
FIG. 7 illustrates a water retaining action of the percolator in accordance with embodiments of the present invention.

However, it has been experimentally demonstrated by the inventor that such a trapped air pocket is not necessarily required for the water retention action to take effect. Rather, even if the intake chamber is open to ambient air, if the attachment device is inverted relatively quickly and completely so that the entirety of the narrow channel is in contact with water and the mouthpiece aperture faces vertically downward, as illustrated in FIG. 7, then the water will rapidly be inhibited from spilling through the channel. In this configuration the water forms a seal with the narrow channel and is held in place. If the water seal is broken, for example by tilting the device until an air channel is formed passing through an upper part of the narrow channel, then the may water spill outward through the channel. This provides a way of draining the water from the device.

In some embodiments, the narrow channel further limits flow rate of substance during inhalation, thereby allowing for improved control over the amount of substance inhaled. In some embodiments, the top of the dome 130 defines a portion of the narrow channel, and further facilitates a long overall path for substance flow relative to a height of the device, since the dome 130 and inner pipe 125 can therefore reach nearly to the top of the device. This concurrently allows both for a potentially larger amount of filtering as well as the water spillage inhibiting feature described above.

FIG. 7 illustrates a narrow channel 715 formed near the mouthpiece aperture, which facilitates retention of water 720 due at least in part to air pressure 710 and/or surface tension when the mouthpiece aperture is oriented downward, as described above. As illustrated, the narrow channel is defined by a top of the dome 130 which is proximate to a splash guard 160.

Figure 8:
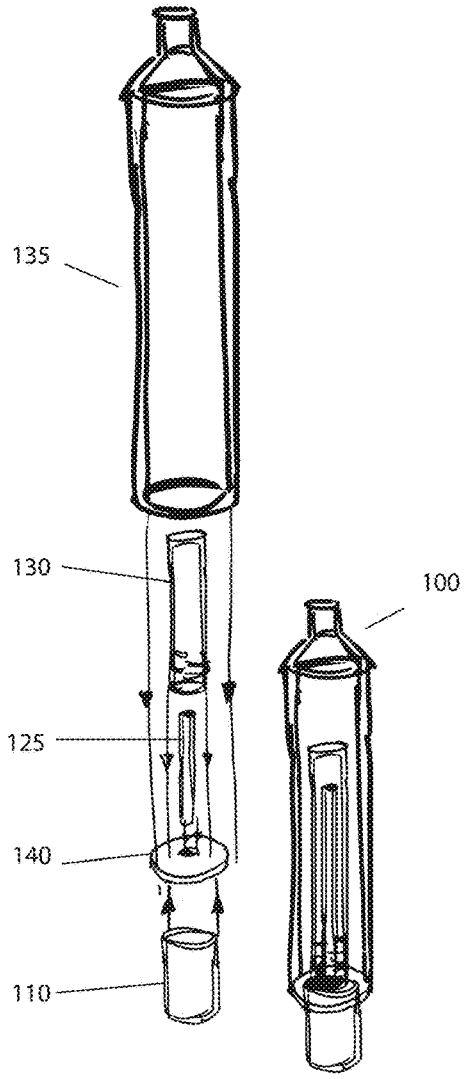
FIG. 8 illustrates an exploded view of a device provided in accordance of the present invention.

FIG. 8 illustrates, for clarity, an exploded view of a device provided in accordance of the present invention in certain embodiments. The attachment device 100 as shown in FIG. 8 comprises a housing 135, a dome element 130, an inner pipe 125, a base 140 and an intake chamber 110.

Figure 9:
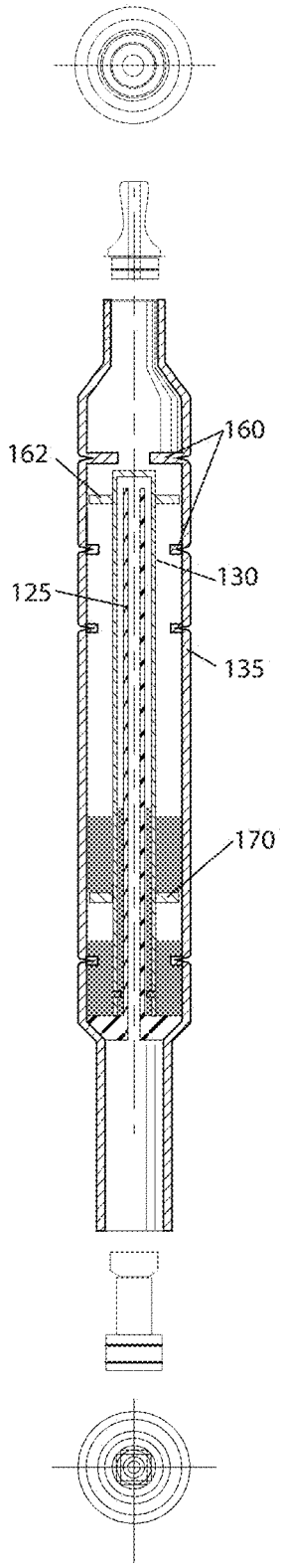
FIG. 9 illustrates a percolator attachment device in accordance with one embodiment of the invention comprising a ring feature, a plurality of splash guards, a dome percolator with an inner pipe and an exterior housing.

Certain embodiments, as shown in FIG. 9, comprise a housing 135 exhibiting splash-guards 160, a dome element 130, an inner pipe 125 and a plurality of hydrolocks. In such an embodiment, a first hydrolock 162 and a second hydrolock 170 exhibit similar dimensions to create separate volumes of liquid.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

The preceding description has been presented with reference to various embodiments. Persons skilled in the art and technology to which this application pertains will appreciate that alterations and changes in the described structures and methods of operation can be practiced without meaningfully departing from the principle, spirit and scope.

The present systems, methods, means, and enablement are not limited to the particular systems, and methodologies described, as there can be multiple possible embodiments which are not expressly illustrated in the present disclosures. It is also to be understood that the terminology used in the description is for the purpose of describing the particular versions or embodiments only, and is not intended to limit the scope of the present application.

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

What is claimed is:

1. An attachment device for liquid percolation filtering of a substance intended for inhalation, said attachment device comprising:

a. an intake chamber having an opening configured to receive each one of a plurality of substance sources in sealing engagement, said plurality of substance sources each belonging to a different corresponding design of device producing a substance intended for inhalation;

b. a mouthpiece for use in inhaling said substance; and c. a liquid pipe percolator section in fluid communication with said intake chamber and said mouthpiece and interposed therebetween, and said liquid pipe percolator configured as a dome percolator, a ring element located within a liquid containing section of said liquid pipe percolator section, said ring element having an inner perimeter contacting an outer sidewall of said dome and an outer perimeter disposed proximate to an inner sidewall of said housing, thereby forming an aperture between said outer perimeter of said ring element and said inner sidewall of said housing;

wherein said aperture prevents the passage of a liquid in a neutral pressure environment while allowing said substance intended for inhalation to pass under a negative pressure environment; and wherein said liquid pipe percolator section comprises a housing, said intake chamber extends substantially in line with said housing and outwardly from a bottom of said housing, and said mouthpiece extends in line with said housing and outwardly from a top of said housing.

2. The attachment device of claim 1, wherein said liquid pipe percolator is configured as a dome percolator and said housing is of cylindrical form.

3. The attachment device of claim 2, wherein said dome percolator comprises a cylindrical inner pipe having a first opening and a second opening at opposing ends thereof, said first opening in fluid communication with the intake chamber, and a cylindrical dome formed over top of said inner pipe and having at least one aperture proximate to a base of said dome and said inner pipe.

4. The attachment device of claim 1 wherein said ring element prevents the passage of a liquid in a neutral pressure environment regardless of orientation of said attachment device.

5. The attachment device of claim 1, wherein said ring element comprises a hydrolock element.

6. The attachment device of claim 1, further comprising a resilient member for interposing between an interior surface of said intake chamber and an exterior surface of at least one of said plurality of substance sources when received in the intake chamber, said resilient member configured to facilitate gripping and sealing engagement of the at least one of said plurality of substance sources.

7. The attachment device of claim 1, wherein at least said intake chamber and said liquid pipe percolator section are integrally formed.

8. The attachment device of claim 1, wherein at least said intake chamber and said liquid pipe percolator section are integrally formed of glass.

9. The attachment device of claim 1, wherein said intake chamber is narrower than said housing, said device further comprising a flared portion connecting said intake chamber and said housing, said flared portion forming a surface for resting said attachment device in a user's hand.

10. The attachment device of claim 1, further comprising a grip formed on an outer surface of said housing.

11. The attachment device of claim 1, wherein said substance source is a secondary device mouthpiece or an atomizer.

12. The attachment device of claim 1, further comprising one or more splash guards extending into said liquid pipe percolator section between a liquid containing section thereof and said mouthpiece, said splash guards configured to inhibit liquid from reaching the mouthpiece due to splashing corresponding to bubbling action during operation of said attachment device.

13. The device of claim 12, wherein said one or more splash guards include two or more splash guards located at different distances from said mouthpiece in a stacked configuration, said two or more splash guards defining openings which are at least partially offset from each other to define a increased resistive path for passage of said substance intended for inhalation.

14. The attachment device of claim 12, wherein said dome percolator comprises a cylindrical inner pipe and a cylindrical dome formed overtop of said inner pipe, said inner pipe and said dome oriented parallel with said housing, and wherein at least one of said one or more splash guards is mounted to said dome.

15. The attachment device of claim 1, wherein one of said plurality of substance sources is received in sealing engagement with said intake chamber, said intake chamber is configured for fluidic communication only with an opening of one of said plurality of substance sources and with said liquid pipe percolator section, and wherein, when a channel accessed by said opening of said one of the plurality of substance sources is sealed by action of a corresponding device producing said substance intended for inhalation, said intake chamber is thereby configured to hold a sealed pocket of air which inhibits backflow of liquid from said liquid pipe percolator section into the intake chamber.

16. The attachment device of claim 1, wherein said attachment device is symmetric about a central axis of said housing, the device thereby balanced with respect to said axis.

17. The attachment device of claim 1, further comprising an optically translucent material configured to receive light produced by said substance source producing said substance intended for inhalation and to convey said light for emission at one or more locations on an exterior surface of said attachment device and away from the opening of said intake chamber.

18. The attachment device of claim 17, wherein said optically translucent material is configured to diffuse said light over a predetermined surface area of said attachment device.

19. The attachment device of claim 17, further comprising a phosphorescent or fluorescent material optically interactive with said one or more locations.

20. The attachment device of claim 1, further comprising a phosphorescent or fluorescent material optically interactive with at least a portion of an exterior surface of said attachment device.

21. The attachment device of claim 1, further comprising one or more protrusions extending into a liquid containing section of said liquid pipe percolator section, said protrusions configured to contact bubbles rising through said a liquid during operation of said attachment device to break up said bubbles, said bubbles containing the substance intended for inhalation, thereby increasing contact surface area between said liquid and said substance intended for inhalation.

22. The attachment device of claim 1, wherein said housing comprises a channel forming an aperture for said mouthpiece, said channel having a cross-sectional area corresponding with the surface tension of said a liquid to prevent passage of said liquid through said channel under a neutral pressure environment, such that when said device is oriented so that said mouthpiece is pointed downward, said surface tension of said liquid is not overcome by the pressure due to the depth of a predetermined volume of liquid held within the housing, thereby inhibiting spillage.

23. The attachment device of claim 1, wherein said housing of the liquid pipe percolation section is configured to define an gaseous volume above a predetermined volume of liquid adequate for operation, and wherein said housing comprises a narrowing portion forming a mouthpiece-aperture for said mouthpiece, said aperture coaxial with said housing, wherein said housing is thereby shaped to contain said predetermined volume of liquid at least partially within said gaseous volume and without flowing out of said mouthpiece-aperture when said attachment device is oriented horizontally.

* * * * *